US005441529A

United States Patent [19]

Dorsch

[11] Patent Number: 5,441,529

[45] Date of Patent: Aug. 15, 1995

[54] THERAPEUTIC BATHING APPARATUS

[76] Inventor: Erwin Dorsch, 11214 Pines Blvd., No. 168, Pembroke Pines, Fla. 33025

[21] Appl. No.: 300,960

[22] Filed: Sep. 6, 1994

[51] Int. Cl.[6] ..... A61H 33/14

[52] U.S. Cl. ..... 607/82; 607/87; 4/568

[58] Field of Search ..... 607/85–87, 607/81–82; 4/541.1–541.5, 550, 567–568, 573.1

[56] References Cited

U.S. PATENT DOCUMENTS

| | | | |
|---|---|---|---|
| 643,094 | 2/1900 | Hensel . | |
| 1,080,678 | 12/1913 | Brueggeman . | |
| 1,531,833 | 3/1925 | Bauer . | |
| 2,300,455 | 11/1942 | Lukats . | |
| 3,692,028 | 9/1972 | Etten et al. | 607/85 |
| 3,885,557 | 5/1975 | Varea | 607/85 X |
| 4,192,024 | 3/1980 | Zigmont | 607/85 X |
| 4,196,479 | 4/1980 | Geisler . | |
| 4,197,838 | 4/1980 | Shill | 607/85 X |
| 4,340,981 | 7/1982 | Vanags . | |
| 4,565,188 | 1/1986 | Hardie . | |
| 4,724,553 | 2/1988 | Bianchi . | |
| 4,761,838 | 8/1988 | Hargrove . | |
| 4,859,345 | 8/1989 | Inagaki | 607/85 X |
| 4,884,574 | 12/1989 | Hardie et al. | 607/87 X |

*Primary Examiner*—Angela D. Sykes
*Attorney, Agent, or Firm*—McHale & Slavin

[57] ABSTRACT

A therapeutic bathing device for cleansing the skin of impurities through the incorporation of ozone into a water spray bath consisting of heated demineralized ultra pure water. The bathing device consists of a two piece enclosure having a top portion which encompasses a lower portion which further operates as a catch basin allowing the recycling of the water. A flow of water through jets incorporated into an inner side wall of the top portion and lower portion directs the purified water toward an occupant placed in a reclined position directly over the catch basin.

17 Claims, 2 Drawing Sheets

THERAPEUTIC BATHING APPARATUS

FIELD OF THE INVENTION

This invention relates to bathing devices, and in particular, to a therapeutic bathing device which is occupied by a person who is bathed by a rinse of ultra pure water injected with ozone.

BACKGROUND OF THE INVENTION

The use of bathing equipment is well known in the art and dates back farther than the recording of patents. Recognition of the need for improving bathing equipment is also welling documented producing various devices to either ease the necessity of cleaning the skin or provide a therapeutic effect during the bathing process. U.S. Pat. No. 643,094 granted in the year 1900 exemplifies the progression of the art by disclosing an oscillating bathtub for the purpose of agitating the water against the body of the bathing person providing a means for cleansing the skin as well as massaging the body. U.S. Pat. No. 1,080,678 discloses a vapor bath apparatus for sealing a conventional bathtub to prevent hot water steam from escaping providing spa like conditioning. U.S. Pat. No. 1,531,833 discloses an improved bathing apparatus which discharges a shower of liquid in an upward direction from below the occupant who may be in a reclining position. A primary objective of the invention is to subject the body to various kinds of liquid for massage or cleaning. U.S. Pat. No. 2,300,455 teaches the use of a bath cabinet wherein a patient undergoing hydrotherapy may be subjected to localized treatments of water directed from impacting jets for the excitation or relaxation of the nervous system through spraying of spinal nerves.

In 1980, U.S. Pat. No. 4,196,479 disclosed the benefits of having a single occupant Turkish type steam bath by claiming a bath cover for use in the modern home. U.S. Pat. No. 4,565,188 issued in 1986 disclosed a vibratory sauna made from a single enclosure which provides a continuous recirculation of heated air through a housing as opposed to the use of pressurized jets, the implication of which is that the pressurized jets of the prior art are directed to the primary purpose of massaging the body. In 1988 U.S. Pat. No. 4,724,553 disclosed an apparatus for wrapping a hydromassage over the entire body of a person in a single direction by use of at least one water spout distributed according to a cylindrical helix injecting a divergent spout around the perimeter of the occupant.

U.S. Pat. No. 4,340,981 disclosed yet another bathing device consisting of a cabinet wherein an occupant can enter the cabinet and sit on a seat and a flexible shower handle allows the occupant to bath their body. Of interest is the bathing device use of a reservoir and heating element to generate steam and a means to collect used water and deliver it to a holding tank. In this invention, water supplied from a reservoir to the heating element to generate steam in a holding tank is provided for collection of all used water. In 1988 U.S. Pat. No. 4,761,838 issued disclosing a contrast heating water spa system based upon a single monolithically formed tube that forms two separate chambers having hot aerated water in one chamber and cold water in a second chamber. The hot water is passed through a filter and heater before injection through high pressure ports. In this invention an ozone generator is coupled between the cold and hot water line providing a disinfection to the water circulating system. A cross line after the ozone disinfectant further permits the cross feed of a quantity of hot water into the cold water system, thus keeping the water chambers disinfected. Ozone is a well known disinfectant process used extensively overseas for maintaining municipal water supplies bacteria free. In the United States, water is typically maintained bacteria free by chemical, namely, sodium hypochlorite or chlorine.

Despite the extensive teachings in the prior art, no device has heretofore disclosed the benefits of using water of such quality that the mere rinsing of a person will operate as a solvent so as to dissolve and remove body surface contaminants. The use of high quality water is well known for its rinsing ability and due to its low amount of total dissolved solids, the quality of the water must be measured by either resistivity or conductivity. For instance, it is well known that water having a quality of one mega ohm or greater allows an automobile dealer to rinse an automobile and forego drying of the automobile as there are insufficient contaminants in the water that would allow residual spotting of the finish. Water with the quality of 21 mega ohms is required in the manufacturing of semi-conductor chips wherein the high quality water operates to remove any and all particles from the surface of the chip without the need for chemicals and the associated disposal problems. The use of ozone injected water further operates to enhance the water by placing the oxygen molecule in such a highly agitated $O_2$ state that during its return to an oxygen $O_3$ state, it operates to destroy bacteria and other matter present in the fluid.

Thus, what is lacking in the art is an enclosed bathing device that operates to bath the occupant with water of such high quality and in an oxygen agitated $O_3$ state that the water will operate to cleanse the surface of the skin and pull contaminants from the dermis as well as provide a non-chemical disinfectant to destroy bacteria. Such a device need include an enclosure that allows ease of access for the occupant and provide a recirculation system for recycling of the water.

SUMMARY OF THE INVENTION

The present invention satisfies this need by provision of a therapeutic bathing device for cleansing the skin of impurities through the introduction of ozone into a water spray bath consisting of heated demineralized ultra pure water. The bathing device consists of a two piece enclosure having a top portion of which encompasses a lower portion which further operates as a catch basin. A flow of water through jets incorporated into an inner side wall of the top portion direct the purified water toward an occupant placed in a reclined position. The water is retained in the lower portion for recycling through the system.

The enclosure includes hydraulic lifts to bias the upper portion allowing the occupant to easily lift the upper portion to enter the unit. Once the occupant is in position, pulling of the upper shell overcomes the biasing force of the hydraulic lift securing the occupant in a leak resistant container. An opening for the occupant's head is provided and a flexible sealing flap prevents water from escaping the housing. The upper portion of the housing includes a water jet system directing the water toward the positioned occupant. The lower portion of the apparatus provides an adjustable seat allowing the occupant to be comfortably positioned in the enclosure. Directly beneath the occupant is a floor having a plurality of openings for drainage of excess water into a reservoir. The openings provide a sufficient opening for the upward direction of water from additional water jets placed along the length of the occupant's position.

Water collected in the reservoir is pulled into a pump for pressurization through a one micron filter and entering into an ultraviolet light of approximately 254 nm causing the destruction of bacteria and excess ozone. The filtered water is then directed outside of the lower portion to a control console which includes a mixed bed demineralizer tank consisting of an exchangeable tank that is regenerated off site containing both cation and anion resin. Demineralized water is directed through a heater capable of withstanding high quality water followed by a monitoring system to verify quality of the water as it exits from the tank and heater. Should the demineralizer resin require regeneration, the water quality indicator will provide such notice. The demineralized and heated water is sent through an orifice pipe allowing the injection of ozone fed from an externally placed oxygen concentrator at a rate less than five liters per minute. The demineralized, heated and now ozonated water is redirected to the bathing unit where spraying through the upper and lower jets surrounding the occupant provides distribution over the occupant's body. The combination of heat, ozone and ultra pure water placed on the human body is unique in that when the oxygen is fed to pores newly dilated and decongested by ionized vapor treatment, the pores are receptive to absorb the oxygen which operates to rejuvenate the skin.

Thus, an objective of the instant invention is to provide a bathing unit that combines demineralized, heated, ozonated, and filtered water for direction over the skin of a body though jets for optimal cleansing of the skin.

Yet still another objective of the instant invention is to provide the bathing of an individual using recycled water that improves through recirculation by use of a demineralized water system and filter for removal of dissolved matter, the recycling saves on electricity by re-use of previously heated water.

Yet still another objective of the instant invention is to teach the use of an ozonator for disinfection of the skin.

Another objective of the instant invention is to disclose a two-piece shell bathing unit having jet placement in a lifting shell which fully encompasses the lower shell to eliminate the possibility of water leakage common among bath units that are split in a vertical fashion.

Still another objective of the instant invention is to provide a pressurized discharge of reservoir water by use of the recirculation pump.

Yet still another objective of the instant invention is to disclose an aesthetically pleasing therapeutic bathing unit that is appealing for placement in homes or spas and can be easily cleaned by simply removing the seat and reservoir cover.

Other objectives and advantages of this invention will become apparent from the following description taken in conjunction with the accompanying drawings wherein are set forth, by way of illustration and example, certain embodiments of this invention. The drawings constitute a part of the specification and include exemplary embodiments of the present invention and illustrate various objects and features thereof.

DETAILED DESCRIPTION OF THE PREFERRED EMBODIMENT

Although the invention has been described in terms of a specific embodiment, it will be readily apparent to those skilled in this art that. various modifications, rearrangements and substitutions can be made without departing from the spirit of the invention. The scope of the invention is defined by the claims appended hereto.

Figure 1:
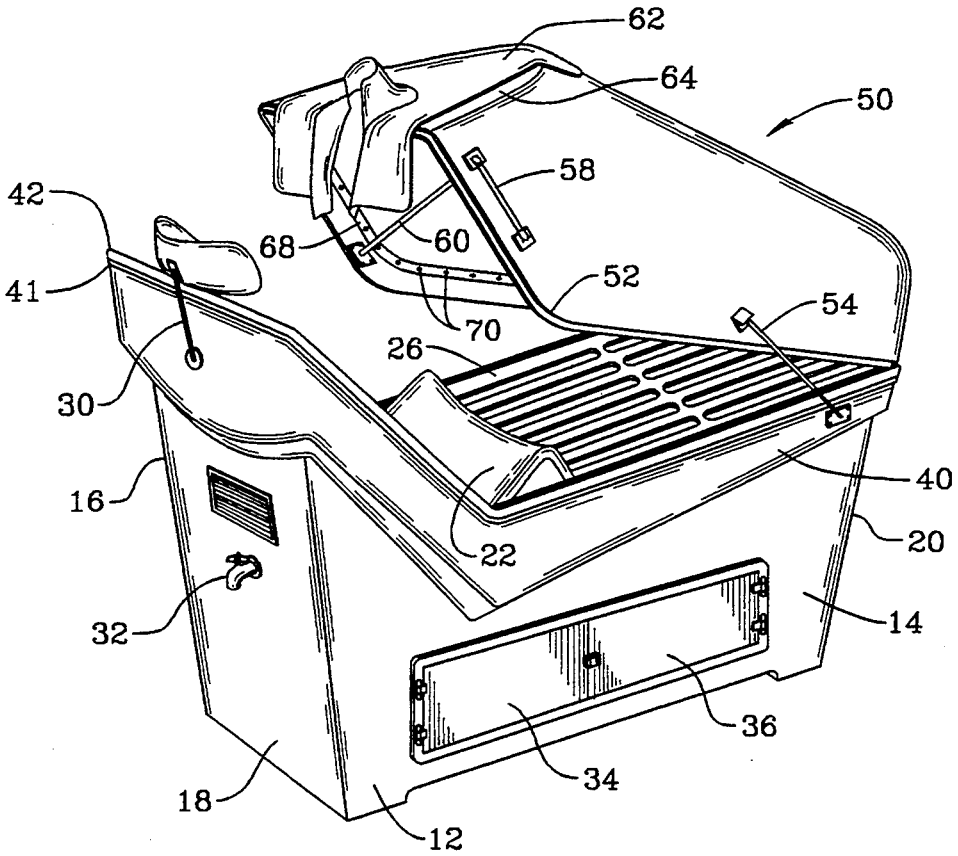
FIG. 1 is a front perspective view of a sauna constructed in accordance with the invention with an upper portion of the shell shown in a raised position.
Figure 2:
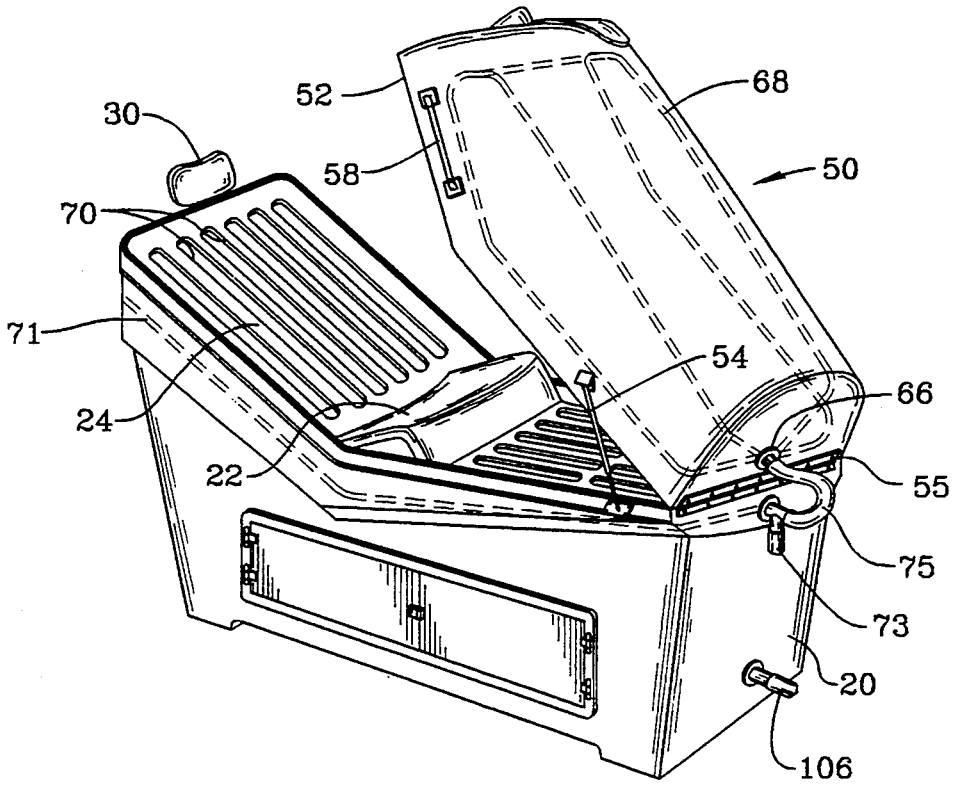
FIG. 2 is a rear perspective view of FIG. 1.

Now referring to the drawings and in particular FIGS. 1 and 2, the therapeutic bath apparatus of the instant invention 10 is illustrated having a lower housing 12 defined by front sidewall 14, back sidewall 16, front end wall 18 and bottom end wall 20. The front end wall 18 is taller than the bottom end wall 20 to provide a back support for an individual, not shown, positioned within the enclosure by provision of an adjustable seat 22 which resides against curved back 24 placing the occupant in a semi-reclined position. Beneath the seat 22 is a false floor 26 having a plurality of drainage openings 28. Adjustable headrest 30 is positioned external the lower housing 12 providing a location for placement of the head of the occupant. Drain 32 provides an expedient connection for drainage of a reservoir located beneath the floor 26 by use of a repressurization pump, described in detail later in this specification.

Doors 34 and 36 provide access to circulation equipment should maintenance be required. The lower portion 12 is formed from a single piece of material, preferably fiberglass, which utilizes an enlarged overhang 40 formed integral with the enclosure which extends around the entire parameter of the lower housing 12. On a leading edge 41 of the overhang 40 is placed gasket material 42 such as ozone resistant rubber providing a continuous seal around the edge to prevent water leakage as well as to protect the operator from scratching their body while climbing into the enclosure.

Shell 50 forms an upper portion of the enclosure 10 and is also constructed from a one piece housing having a shape communicating with the lower housing 12 including a rib 52 formed integral with the shell providing a free edge surrounding the perimeter. During use the rib 52 is juxtapositioned to the seal 42 preventing water spray from exiting the enclosure. Hydraulic lifts 54 and 56 bias the upper shell 50 along end 20 by use of a pivotal hinge 55 so as to allow the raising and lowering of the shell 50 with minimal effort. The hydraulic lifts 54 and 56 operate in a similar fashion to the lifts found on a conventional automobile hatch-back providing a means for positioning the shell 50 at various openings. External handle 58 provides a lifting of the shell allowing a person to enter into the enclosure and further providing a means for a person outside the enclosure to lift or close the shell as needed. Handle 60 is located inside the shell 50 providing the occupant with a leveraged bar for lifting or closing of the shell 50. A safety switch, not shown, is provided to shut down the system when the shell 50 is separated from lower housing 12. The shut down prevents water spray from exiting the housing.

So as to allow the use of the device for occupants of various dimensions, the seat 22 is adjustable allowing placement of the head in the headrest 30 despite the height of the individual. Mat 62 is provided for wrapping around the occupant's neck and further provides an insulator from excess steam vapor which may accumulate around the upper body of the occupant. To this end, the mat 62 is enlarged to cover a majority of the end 64 of the shell 50 and includes sufficient material so as to wrap the shield around the back of the occupant's neck when the enclosure has been closed, thereby acting as an insulator to prevent heat that has accumulated around the occupant's shoulders from heating the base of the headrest leading to occupant discomfort.

The headrest 30 is curved so as to support a portion of the neck in a sufficient width so as to deflect any excess heat that may rise from the enclosure. Optionally a fan, not shown, can be coupled to the headrest for directing excess heat away from the occupant's face.

Water is directed into the bottom end of the apparatus simultaneously injecting water into the lower portion 12 and the upper portion 50. Referring to the upper portion 50 a hub 66 is fluidly coupled to at least four water carrying pipes 68 formed integral to the shell 50 with a plurality of water jets 70 disposed approximately every three inches. The water carrying pipes direct water along each side of the occupant in an angle off center the occupant so as to rinse the upper surface of the body. Similarly, a water pipe 71 is located on the bottom portion 12 of the unit wherein the hub 72 directs water along the lower portion of the occupant's body to a plurality of jets 70 which direct the ultra pure water against the back surface of the occupant's body. Inlet coupling 73 provides a coupling mechanism for receipt of externally conditioned water, as described hereafter, with a flexible hose 75 coupling the lower portion 12 to the upper portion 50.

Figure 3:
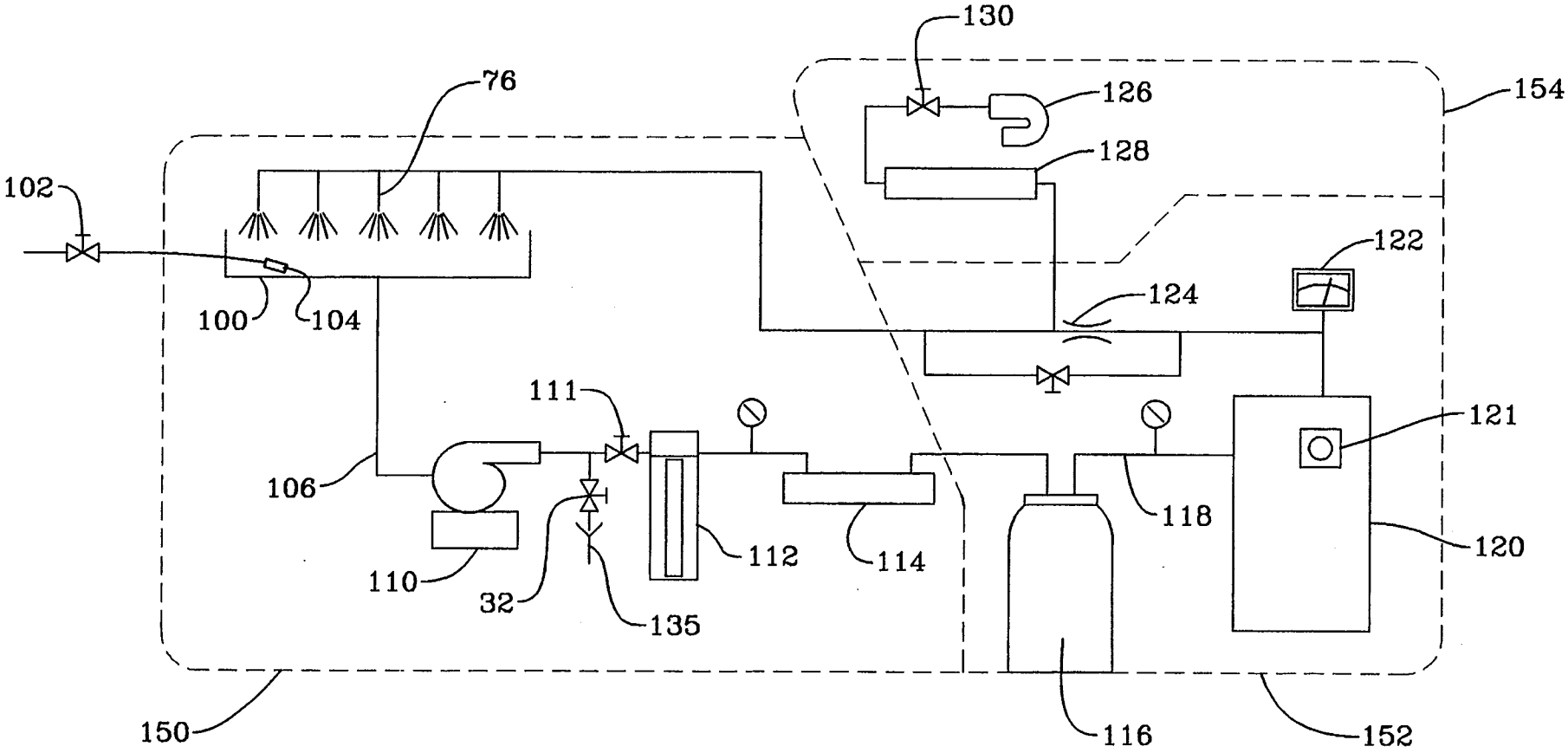
FIG. 3 is a flow schematic of the interconnected hydraulic components.

Now referring to FIG. 3 shown is a flow schematic of the hydraulic system for the instant invention. A reservoir 100, placed beneath the occupant, is sized sufficiently so as to provide sufficient water for the system without causing cavitation of a recirculation pump. The reservoir 100 can be filled externally by coupling to an external water supply 102 which delivers water into tile reservoir 100 wherein a float valve 104 or the like overflow protector is provided to maintain the reservoir in a predetermined fluid level. At the bottom of the reservoir is a suction pipe 106 which is coupled to pump 110 used for recirculation of the water as well as pressurization for operation of the water jets 70 as described in detail later in this specification, the pump pressure can be controlled by a regulator valve 111. The pressurized water is delivered to a filter housing 112 having a one micron or smaller rating replaceable cartridge providing removal of particulates before introduction of the water in an ultraviolet light 114 having a wave length of 254 nm providing the destruction of bacteria. The higher wave length ultraviolet light further operates to destroy ozone which is injected into the system, also described later in this specification. Once the water has been subjected to the ultraviolet light it is inserted into a demineralizer tank 116 defined as a portable exchange tank having a mixed bed of cation and anion regenerable resin. In operation, the demineralizer exchanges cations for the hydrogen ion and anions for the hydroxide ion. Thus, calcium and sodium is exchanged for hydrogen while chlorides are exchanged for the hydroxide ion providing a pure water, the quality increased by use of the resin in a mixed bed form. In a mixed bed demineralizer, it is not uncommon for the quality of the water to be of such high quality that it can only be measured by the water's lack of resistivity.

The ultraviolet light 114 assists in the prevention of resin contamination from bacteria growth. During regeneration the mixed bed resin goes through a process wherein the cation resin is separated from the anion resin wherein the cation is regenerated with hydrochloric or sulfuric acid and the anion resin regenerated with caustic to remove the exchanged cations and anions, at a pH range that bacteria cannot survive. In this operation, the demineralizer is followed by a pressure gage 118 to monitor compaction of resin delivered through a heater 120 made of high quality stainless steel components capable of withstanding high purity water. The temperature of the heated water can be adjusted 121 and then checked for quality through a resistivity or conductivity monitor 122 well known in the art as a suitable device for determining the quality of water. The heated water is then injected 124 with oxygen placed in an ozonated state by use of an oxygen concentrator 126 which is run through an ozonator 128 which generates $O_3$ by a process commonly known in the industry and typically based upon a reduced wave length ultraviolet light such as one operating at 174 nm. The ozonated air is injected into the water supply by the injector 124 at an adjustable 130 level of less than 5 liters per minute. The water is then delivered to the enclosure wherein a plurality of water jets 70 placed throughout the enclosure for delivery of filtered, ultra pure, heated, and ozonated water mixture.

The reservoir 100 again operates to collect excess water to repeat the process of recirculation through the filter 112, demineralizer 116, heater 120 and ozonator injection 124. During recirculation it should be noted that recycled water is preferred in place of new water as the recycled water is of higher quality wherein only the contaminants from the occupant must be removed whereas the contaminants from an inlet water supply would far exceed such values. During recirculation the demineralizer produces very pure water and operates to enhance the quality of the water through the continuous recirculation of the system, in particular, the demineralizer 116 as well as the filter 112. Further, the heater 120 operates more efficiently as the water being recycled retained a majority of the heat thereby reducing electrical costs. It should be noted that excess ozone is destroyed through the higher level ultraviolet light 114 thereby preventing the oxidant from entering the demineralizer tank 116.

In construction, it has been found most preferable to have the recirculation pump 110, the filter 112, and the ultraviolet light 114 placed within one enclosure such as the lower portion of the enclosure 12 and as defined by component line 150. In this manner a separate unit can attach to the main inlet enclosure enclosing the demineralizer tank 116, the water heater 120, and the ozonator 128 wherein all piping is accomplished within the second unit and a quick connect can be made from the items as defined by component line 152. In this manner the high voltage transformer and heater both of which generate heat can be placed external the enclosure so as not to add to the heat within the enclosure or present components requiring additional electricity to the confines of the enclosure. The second unit would also include the water quality control light and pressure gages for determination of the mixed bed quality. For efficiency purposes, concentrated oxygen is delivered from a commercially available oxygen concentrator to the ozonator 128 for subsequent injection into the ozonator injector, the separate unit defined by component line 154. The preferred method of introducing the ozone into the water stream is by use of an orifice placed in line wherein the ozone is pulled into the water stream on the suction side of a conventional orifice type in line injection mechanism. The system can be drained by opening of the drain valve 32 and directing the water to a drain pipe 135.

The system can be viewed as a method of therapeutic bathing comprising the steps of:

(A) transferring a supply of water from a reservoir through an ultraviolet light;

(B) removing particulates greater than one micron from said water;

(C) purifying water through a mixed bed demineralizer;

(D) heating said purified water;

(E) inserting ozone into said purified and heated water;

(F) placing an individual over said reservoir; and (G) spraying said water over the body of the individual.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What I claim is:

1. A therapeutic bathing apparatus for rinsing the body of an individual without submersion of the individual beneath the bathing water, said apparatus comprising:

an enclosure having a lower member pivotally coupled to an upper member, said lower member having an elevated seating position for supporting the torso of an individual in a reclined position;

a drain floor mounted on said lower member oriented in a horizontal plane for supporting the legs of the individual;

a reservoir positioned in said lower member beneath said drain floor and fluidly communicated to said floor drain;

a pressurization pump having a inlet port coupled to said reservoir for directional pressurization of raw water placed within said reservoir through a delivery port;

a cartridge filter means having an inlet port fluidly coupled to said delivery port of said repressurization pump and an outlet port, said filter means for removal of particles from the pressurized raw water;

a portable exchange demineralizer having a mixed bed of cation and anion resin bed with an inlet port fluidly coupled to said outlet port of said filter for passage of the raw water through contact with said resin bed and a purified water outlet port producing purified water through ion exchange;

a heating element operatively connected to said purified water outlet port for raising the temperature of the purified water;

ozone generation means having an injector for insertion of a predetermined amount of ozone into the purified water;

a spraying means located in said lower and upper housings for directing pressurized purified ozonated water against the body of the individual situated within said enclosure providing a therapeutic bath wherein excess water flows through said drain floor for collection in said reservoir for repeating of water pressurization and purification.

2. The therapeutic bathing apparatus according to claim 1 wherein said lower member includes an adjustable seat means providing said elevated seating position.

3. The therapeutic bathing apparatus according to claim 1 including hydraulic lifts for biasing one end of said upper member in a raised position allowing an individual to sit on said seating position and swing their legs on to said drain floor.

4. The therapeutic bathing apparatus according to claim 1 wherein said spraying means is further defined as a plurality of water orifices positioned to spray the purified water over the entire body of the individual situated within said enclosure.

5. The therapeutic bathing apparatus according to claim 1 including an ultraviolet light positioned between said cartridge filter and said demineralizer having an inlet port coupled to said filter and an outlet port coupled to said demineralizer fluidly communicated therewith providing bacteria and residual ozone destruction.

6. The therapeutic bathing apparatus according to claim 1 wherein said cartridge filter prevents passage of particles larger than one micron.

7. The therapeutic bathing apparatus according to claim 1 wherein an opposite end of said pivotally coupled upper member provides an opening for extension of an individual's head and neck and said lower member includes an adjustable headrest means for support of the individual's head.

8. The therapeutic bathing apparatus according to claim 7 wherein said opening is sealed by a flexible sleeve adapted to conform to the neck of the individual.

9. The therapeutic bathing apparatus according to claim 1 wherein said pump and said cartridge filter are located in a cavity beneath said reservoir in said lower member.

10. The therapeutic bathing apparatus according to claim 1 wherein ozone is injected at a rate of up to 5 liters per minute through an orifice injection nozzle.

11. The therapeutic bathing apparatus according to claim 1 including a means for sealing said lower member to said upper member.

12. A therapeutic bathing apparatus for rinsing the body of an individual without submersion of the individual beneath the bathing water, said apparatus, comprising:

an enclosure having a lower member pivotally coupled to an upper member, said lower member having an elevated seating position for supporting the torso of an individual in a reclined position said upper member defined as a one piece shell pivotally coupled at one end to said lower member having an opening for insertion of an individual's head and neck at an opposite end;

means for biasing said shell in a raised position in relation to said lower support housing;

a drain floor mounted on said lower member oriented in a horizontal plane for supporting the legs of the individual;

a reservoir positioned in said lower member beneath said drain floor and fluidly communicated to said floor drain;

a pressurization pump having an inlet port fluidly coupled to said reservoir for directional pressurization of raw water placed within said reservoir through a delivery port;

a one micron cartridge filter having an inlet port fluidly coupled to said delivery port of said repressurization pump and an outlet port, said filter for removal of particles from the pressurized raw water;

an ultraviolet light having an inlet port fluidly coupled to said outlet port of said filter for destruction of bacteria and oxidants;

a portable exchange mixed bed demineralizer with a raw water inlet port fluidly coupled to said outlet port of said ultraviolet light after contacting said mixed being a purified water outlet port producing purified water through ion exchange;

a heating element operatively connected to said purified water outlet port for raising the temperature of the purified water;

ozone generation means having an injector for insertion of a predetermined amount of ozone into the purified water;

a spraying means formed integral said upper and said lower housing for directing purified ultra pure water ozonated water against the body of the individual situated within said enclosure providing a therapeutic bath wherein excess water flows through said drain floor for collection in said reservoir for repeating of water pressurization and purification.

13. The therapeutic bathing apparatus according to claim 12 wherein said spraying means is further defined as a plurality of water jets dispersed approximately every three inches along a longitudinal length of an inner surface of said upper and lower members for rinsing the body of an individual situated within said enclosure.

14. The therapeutic bathing apparatus according to claim 12 wherein said opening is sealed by a flexible sleeve adapted to conform to the neck of the individual.

15. The therapeutic bathing apparatus according to claim 12 including a safety switch operatively associated with said upper member and said lower member, said safety switch disconnecting power to said apparatus when said cover is separated from said lower member.

16. A therapeutic bathing method comprising the steps of:

(A) situating an individual within an enclosure having a lower member housing a seat and reservoir and an upper member pivotally coupled to said lower member;

(B) filling said reservoir with raw water;

(C) transferring a portion of the raw water from said reservoir through an ultraviolet light for destruction of bacteria and oxidants;

(D) removing particulates greater than one micron from the raw water;

(E) directing raw water through a mixed bed demineralizer for producing purified water;

(F) heating the purified water;

(G) inserting ozone into the purified heated water; and (H) spraying the purified water over the body of the individual situated in said enclosure.

17. The therapeutic bathing method according to claim 16 including the step of: (G) recirculating water by collection of water in said reservoir wherein said transferring of water through the ultraviolet light, filter, and mixed bed demineralizer purifies the water.

* * * * *